US006010374A

United States Patent [19]

Miwa

[11] Patent Number: 6,010,374

[45] Date of Patent: Jan. 4, 2000

[54] SPACER RETAINING STRUCTURE

[75] Inventor: Takeya Miwa, Shizuoka, Japan

[73] Assignee: Yazaki Corporation, Tokyo, Japan

[21] Appl. No.: 08/925,745

[22] Filed: Sep. 9, 1997

[30] Foreign Application Priority Data

Sep. 9, 1996 [JP] Japan ..... 8-237855

[51] Int. Cl.[7] ..... H01R 13/434

[52] U.S. Cl. ..... 439/752

[58] Field of Search ..... 439/752, 595

[56] References Cited

U.S. PATENT DOCUMENTS

| | | | |
|---|---|---|---|
| 5,252,096 | 10/1993 | Okada | 439/752 |
| 5,299,958 | 4/1994 | Ohsumi | 439/752 |
| 5,516,308 | 5/1996 | Yamanashi | 439/752 |

FOREIGN PATENT DOCUMENTS

| | | |
|---|---|---|
| 0 511 649 | 11/1992 | European Pat. Off. . |
| 42 29 279 | 3/1993 | Germany . |

*Primary Examiner*—Gary F. Paumen
*Attorney, Agent, or Firm*—Finnegan, Henderson, Farabow, Garrett & Dunner, L.L.P.

[57] ABSTRACT

A spacer retaining structure 1 of the invention includes: a housing 2 and a spacer 10. The housing has a hollow portion 5 arranged in the middle of a top wall 3*a* so as to pass through the housing 2 vertically and a plurality of terminal accommodating chambers 6. The spacer 10 moves within the hollow portion 5 from a temporarily retained position to a regularly retained position. The spacer 10 also has lock portions 9 at openings 8 that correspond to the terminal accommodating chambers 6 of the housing 2, and has beamlike flexible members 15 having temporarily retaining projections arranged on a front end face of the a side wall 11*a* and regularly retaining projections 14 arranged on a rear end face through slits 13. Each regularly retaining projection 14 is arranged close to a corner portion 20 between the side wall 11*a* and a top wall 18, and the slits 13 extend over the corner portion 20 between the side wall 11*a* and the top wall 18 so as to be at right angles to each other. Further, the housing 2 has temporarily retaining portions 16 and regularly retaining portions 17.

2 Claims, 5 Drawing Sheets

SPACER RETAINING STRUCTURE

BACKGROUND OF THE INVENTION

1. Field of the Invention

The invention relates to a spacer retaining structure for locking connecting terminals within a housing, and more particularly to a spacer retaining structure for retaining a spacer in a hollow portion arranged within the housing.

2. Related Art

Various types of spacer retaining structures have theretofore been known. For example, Unexamined Japanese Patent Publication No. Hei. 5-144499 discloses the following spacer retaining structure.

The conventional spacer retaining structure 51 shown in FIG. 6 has a housing 2 and a terminal locking spacer 60. The housing 2 has not only a plurality of axially extending terminal accommodating chambers 6 arranged therein, but also a hollow portion 5 formed in the middle portion of one of outer peripheral walls 3, i.e., a top wall 3*a* so as to pass through the housing 2 vertically while traversing partition walls 4. The spacer 60 has not only openings 8 that correspond to the plurality of terminal accommodating chambers 6 but also lock portions 9 that retain connecting terminals 7 at the openings 8, and moves from a temporarily retained position to a regularly retained position while inserted from the hollow portion 5.

Each of vertical wall portions 11 that constitute the spacer 60 has not only temporarily retaining projections 12 disposed on the front end face side thereof, but also flexible members 65 having regularly retaining projections 14 formed through slits 63 on the rear end face side thereof, each flexible member 65 being supported at both ends thereof. Further, the housing 2 has temporarily retaining portions 16 and regularly retaining portions 17 arranged. Each temporarily retaining portion 16 is engageable with the corresponding temporarily retaining projection 12 when the openings 8 are inserted to positions substantially coinciding with the terminal accommodating chambers 6. Further, each regularly retaining portion 17 is engageable with the corresponding regularly retaining projection 14 when a lock portion 9 engages with a corresponding retaining hole 25 of a connecting terminal 7 to reach a regularly retained position from the aforementioned retained position, the regularly retained position being such a position as to prevent the terminal from being released from the rear.

It may be noted that the flexible members 65 are arranged on the side walls 61*a* serving as the vertical wall portions 61 positioned on both ends of the spacer 60, but also the slits 63 are arranged so as to pass through slit openings 63*a* formed in a top wall 68. However, one end of each flexible member 65 is coupled and fixed to the corresponding side wall 61*a* at a coupling portion 68*a* of the top wall 68, so that the flexible member 65 is fixed at both ends thereof. Further, each regularly retaining projection 14 is arranged almost in the middle of the rear end face of the corresponding flexible member 65.

Further, a flexible lock arm 24 engageable with a retaining hole 25 of the connecting terminal 7 is arranged on an inner peripheral wall confronting a bottom wall 21 in the front of each of the plurality of terminal accommodating chambers 6 independently of the lock portion 9.

Further, in order to facilitate the retaining operation, slopes 12*a*, 16*a* are arranged on the lower surface of each temporarily retaining projection 12 and the upper surface of each temporarily retaining portion 16. Further, slopes 14*a*, 17*a* are arranged on the upper and lower surfaces of each regularly retaining projection 14 and the upper surface of each regularly retaining portion 17.

In the thus constructed conventional spacer retaining structure 51, first, the spacer 60 is inserted from above the hollow portion 5 of the housing 2, and when the spacer 60 has reached the temporarily retaining position, the temporarily retaining projections 12 are retained by the temporarily retaining portions 16. At this instance, the openings 8 of the spacer 60 substantially coincide with the terminal accommodating chambers 6. Then, when the connecting terminal 7 having a wire 26 caulked at the rear portion thereof is inserted from the rear end of a terminal accommodating chamber 6, the retaining hole 25 is retained with the flexible lock arm 24, so that the connecting terminal 7 can be prevented from being released from the rear.

Then, when the spacer 60 is pushed further downward, not only the regularly retaining projections 14 are retained by the regularly retaining portions 17, so that the spacer 60 is retained in the regularly retained position, but also the connecting terminal 7 is retained by the corresponding lock portion 9, so that the connecting terminal 7 can be prevented from being released from the rear doubly.

However, in the aforementioned conventional spacer retaining structure 51, each flexible member 65 is fixedly supported at both ends thereof as shown in FIG. 9. Therefore, in order to set the amount of flexion at a regular retaining projection 14 to such a predetermined value $\delta_{22}$ as to be retained by the corresponding regularly retaining portion 17, the length $l_2$ of the flexible member 65, i.e., the length of the slit 63 must be made larger than that of a cantilevered flexible member as will be described later using theoretical equations. Therefore, the height $L_2$ of the spacer 60 becomes larger, which in turn imposes the problem of increasing also the size of the housing 2.

Further, when the length of the flexible member 65 is reduced, the maximum tensile stress caused within the flexible member 65 is increased as will also be described later using theoretical equations. Therefore, when the spacer 60 is attached to and detached from the hollow portion 5 of the housing 2 frequently, the flexible members 65 become so weak as to be plastically deformed or even broken in some cases.

Then, differences in mechanical performance between the aforementioned cantilevered flexible member 75 and the flexible member 65 supported at both ends will be described with reference to FIGS. 7 to 9. Assuming that the length of the cantilevered flexible member 75 shown in FIGS. 7 and 8 is $l_1$; the pushing force to be applied to the corresponding regularly retaining projection 14 that serves as an acting point is $W_1$; the flexion at the acting point is $\delta_1$, the maximum bending moment caused within the flexible member 75 is $M_{1\ max}$; the second moment of inertia obtained by the cross section of a beam is I; and the Young's modulus of a material is E, then the flexion $\delta_1$ is given as follows.

$$\delta_1 = W_1 \cdot (l_1)^3 / 3EI \tag{1}$$

$$M_{1\ max}\ W_1 \cdot l_1 \tag{2}$$

Similarly, assuming that the span of the flexible member 65 as a beam supported at both ends shown in FIGS. 6 and 9 is $l_2$; the pushing force to be applied to the corresponding regularly retaining projection 14 that serves as an acting point is $W_2$; the flexion at the acting point is $\delta_2$, the maximum bending moment caused within the flexible member 65 is $M_{2\ max}$; the second moment of inertia obtained by the cross section of a beam is I; and the Young's modulus of a material is E, then $$\delta_2\ W_2\cdot(l_2)^3/192EI \tag{3}$$

$$M_{2\ max}=W_2\cdot l_2/8 \tag{4}$$

Here, if the requirement for causing the flexible member 65 supported at both ends thereof and the cantilevered flexible member 75 to apply the pushing forces serving as the same holding force with the same flexion so that the regular retaining projections 14 respectively arranged on the flexible members 65, 75 can ride over the corresponding regular retaining portions 17 and so that the regularly retaining projections 14 can be held strongly is a requirement for satisfying $\delta_1=\delta_2$ and $W_1=W_2$. Therefore, this requirement can be expressed as follows using equations (1) and (3).

$$W_1\cdot(l_1)^3/3EI=W_2\cdot(l_2)^3/192EI \tag{5}$$

When equation (5) is simplified using the above conditions, $$l_2=4\cdot(l_1) \tag{6}$$

According to equation (6), the span $l_2$ of the flexible member 65 supported at both ends must be four times the arm length $l_1$ of the cantilevered member 75. Therefore, if the flexible member 65 is of the type that is fixedly supported at both ends, the height of the spacer 60 and the housing 2 is increased, and this in turn imposes the problem that the size of the spacer 60 and the housing 2 is increased.

Then, the maximum tensile stresses caused within the flexible members 65, 75 when the flexion $\delta_1$ is equal to the flexion $\delta_2$ are compared by setting the lengths of the flexible members 65, 75 to the same value, i.e., $l_1=l_2$. In this case, what is required to do is to compare the maximum bending moments $M_{1\ max}$ and $M_{2\ max}$ since both flexible members 65, 75 have the same cross section and are made of the same material. When simplified using this requirement, equation (5) becomes as follows.

$$W_2=64\cdot W_1 \tag{7}$$

Further, if the quotient obtained by dividing equation (4) by equation (2) is substituted into equation (7), the following equation can be given.

$$M_{2\ max}=8\cdot M_{1\ max} \tag{8}$$

This equation (8) indicates that the maximum tensile stress caused within the flexible member 65 of the type that is fixedly supported at both ends is eight times the maximum tensile stress caused within the cantilevered flexible member 75 under the aforementioned requirement.

Thus, if the flexible member 65 is of the type that is fixedly supported at both ends, the maximum tensile stress caused is greater than that of the cantilevered flexible member 75. Therefore, when the spacer 60 is attached to and detached from the housing 2 frequently, imposed is the problem that the flexible member 65 becomes so weak as to be plastically deformed or even broken in some cases.

Further, to have the flexible member 65 replaced with the cantilevered flexible member 75 as shown in FIG. 7 in order to overcome the aforementioned problem, not only the coupled portion 68*a* of the top wall 68 shown in FIG. 6 must be cut away and removed, but also a cut groove 70 must be formed in order to separate the flexible member 65 from the top wall 68 and an intermediate partition wall 69. Otherwise, the function as the cantilevered flexible member cannot be performed. Therefore, another problem that the molds to be used become complicated, which in turn elevates the cost of manufacture.

SUMMARY OF THE INVENTION

The invention has been made in view of the aforementioned problems. The object of the invention is, therefore, to provide a spacer retaining structure that can ensure that a predetermined holding force will be given to each regularly retaining projection, and that can be downsized and that has flexible members that do not become weak.

The aforementioned problems can be overcome by a spacer retaining structure. Such spacer retaining structure includes: a housing having not only a plurality of axially extending terminal accommodating chambers arranged therein but also a hollow portion passing through one of outer peripheral walls in the middle of such one of the outer peripheral walls so as to traverse partition walls; and a connecting terminal locking spacer having not only openings corresponding to the terminal accommodating chambers but also lock portions for locking connecting terminals, and moving from a temporarily retained position to a regularly retained position while inserted from the hollow portion. Not temporarily retaining projections are arranged on one end face side of the spacer, the one end face side being as viewed in an axial direction of the spacer, but also beamlike flexible members having regularly retaining projections are arranged on the other end face side through slits. Further, not only temporarily retaining portions are arranged on the housing side, the temporarily retaining portions being engageable with the temporarily retaining projections when the openings are inserted to such a position as to coincide with the terminal accommodating chambers, but also regularly retaining portions are arranged on the housing side, the regularly retaining portions being engageable with the regularly retaining projections when the lock portions reach the regularly retained position while engaged with the connecting terminals, the regularly retained position being such a position as to prevent the connecting terminals from being released from the rear.

In the aforementioned spacer retaining structure, not only each of the regularly retaining projections is arranged close to a corner portion between a side wall and either a top wall or a bottom wall of the spacer, but also each of the slits is formed so as to extend over the side wall and either the top wall or the bottom wall close to the corner portion.

According to the thus constructed spacer retaining structure of the present invention, not only each regularly retaining projection is arranged close to a corner portion between a side wall and either a top wall or a bottom wall of the spacer, but also each slit is formed so as to extend over the side wall end either the top wall or the bottom wall close to the corner portion.

Therefore, the ends of the two cantilevered flexible members arranged so as to be at right angles to each other are coupled to each other at each corner portion. As a result, not only the length of the slit can be reduced with respect to the amount of flexion, but the height of the spacer can be reduced as well. Hence, both the spacer and the housing can be downsized.

Further, not only the pushing force serving as a holding force of the regularly retaining projections can be almost doubled without increasing the maximum stress caused when a simple cantilevered flexible member has flexed, but also the maximum stress caused within the flexible members can be reduced to a small value although the pushing force given by such flexible members is large. Therefore, even if the spacer is attached to and detached from the housing frequently, the plastic deformation or breakage of the flexible members due to the flexible members becoming weak can be prevented reliably.

Further, the aforementioned problems can also be overcome by a spacer retaining structure of the present invention. That is, the spacer retaining structure of the present invention is characterized in that not only each of the flexible members formed by the slits is separated close to the corner portion, but also each of the regularly retaining projections is arranged so as to project from a front end of one of the separated flexible members and is brought into contact with a front end of the other separated flexible member.

According to the thus constructed spacer retaining structure, not only the flexible member extending at right angles is separated close to the corner portion, but also the regularly retaining projection is arranged so as to project from the front end of one of the separated flexible members and the regularly retaining projection is brought into contact with the front end of the other separated flexible member. Therefore, not only the pushing force serving as the holding force of the regularly retaining projections become two times that of the cantilevered flexible members, but also the maximum tensile stress caused within the flexible members can be controlled to a small value.

BRIEF DESCRIPTION OF THE DRAWINGS

FIG. 8 is a diagram illustrative of a principle of a cantilevered flexible member; and FIG. 9 is a diagram illustrative of a principle of a flexible member that is fixed at both ends thereof.

DETAILED DESCRIPTION OF THE PREFERRED EMBODIMENTS

Figure 1:
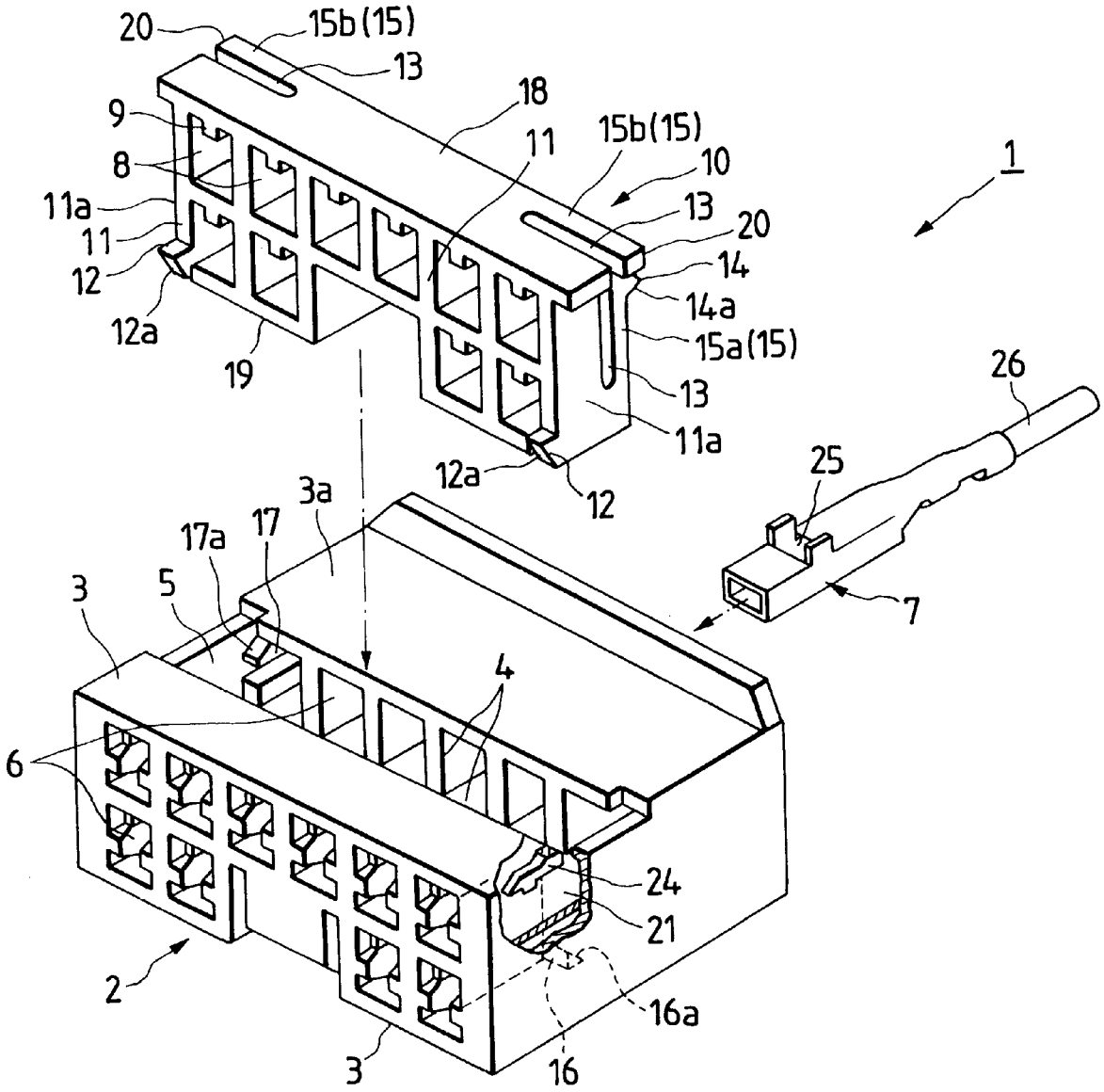
FIG. 1 is an exploded perspective view showing a spacer retaining structure, which is a first mode of embodiment of the invention.
Figure 2A:
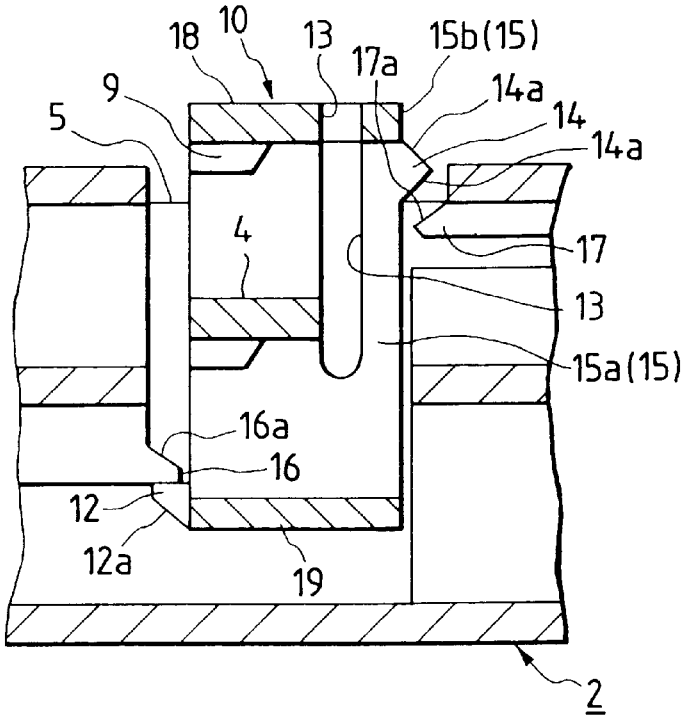
FIGS. 2(*a*) and 2(*b*) are diagrams illustrative of an operation around a spacer in FIG. 1 with part FIG. 2(*a*) showing a temporarily retained condition of the spacer and part FIG. 2(*b*) a regularly retained condition of the spacer.
Figure 2B:
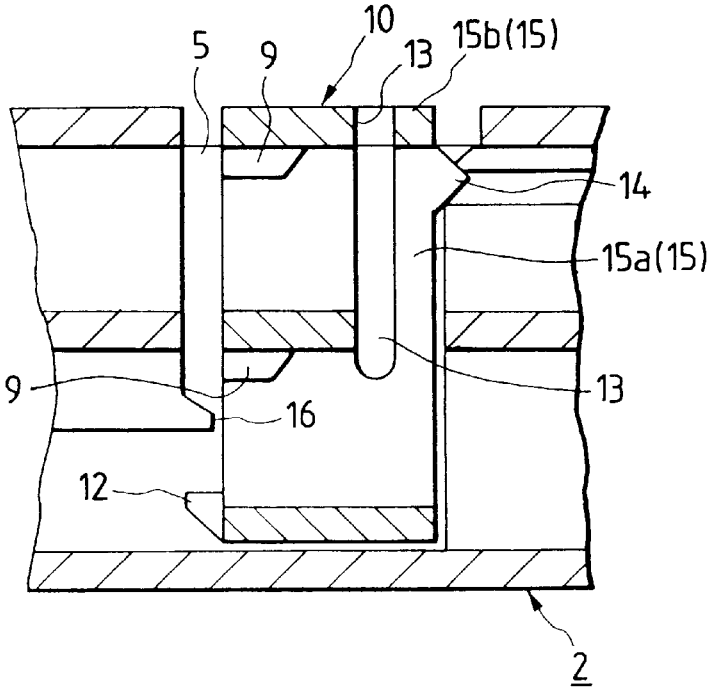
Figure 3:
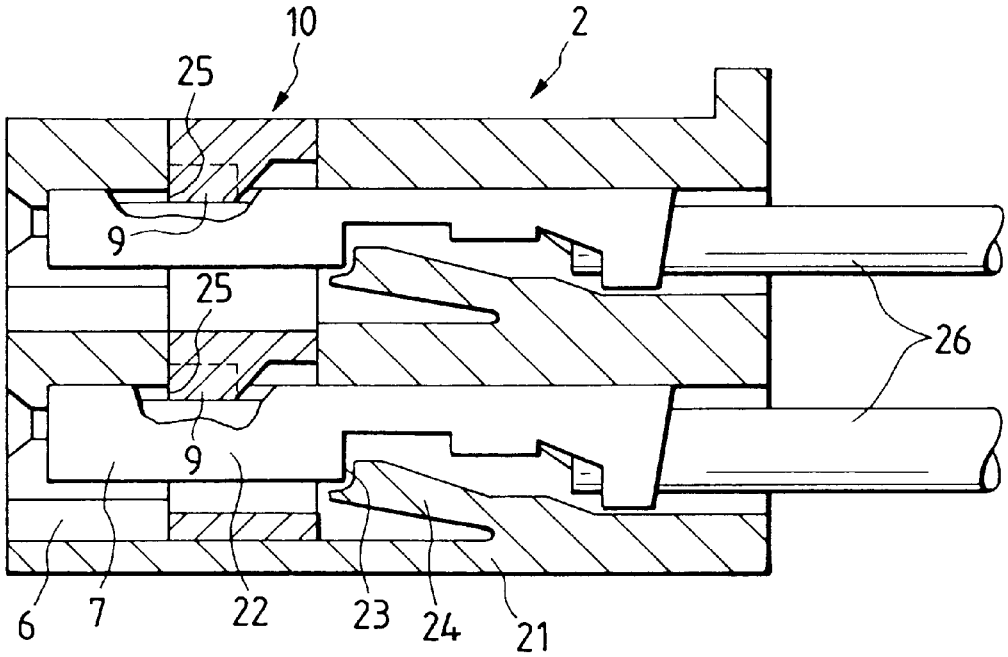
FIG. 3 is a sectional view showing an assembled condition in FIG. 1.
Figure 4:
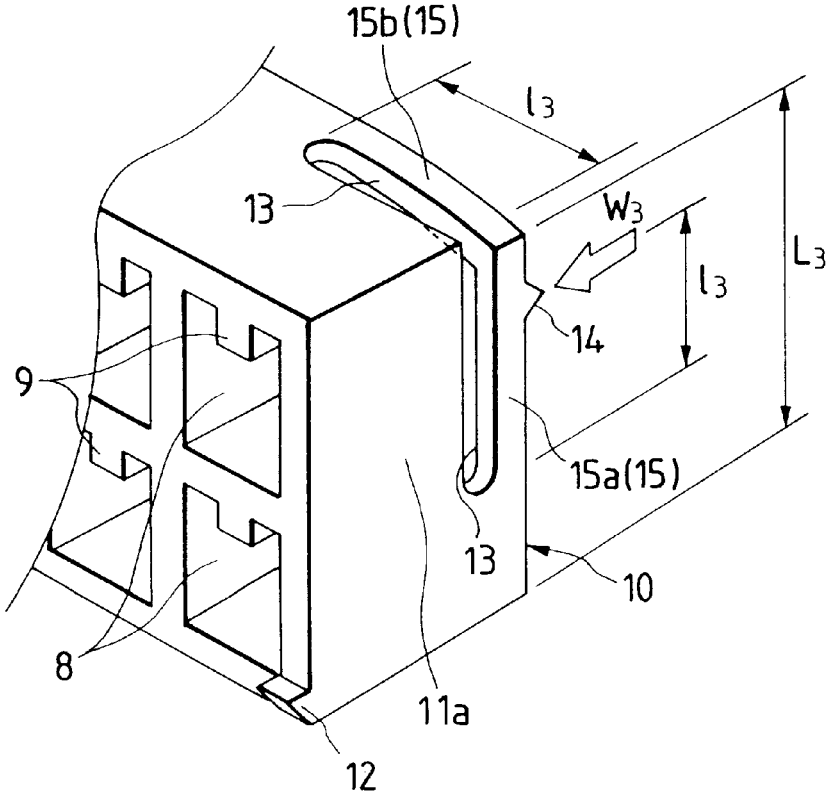
FIG. 4 is a diagram illustrative of an operation around slits in FIG. 1.
Figure 5:
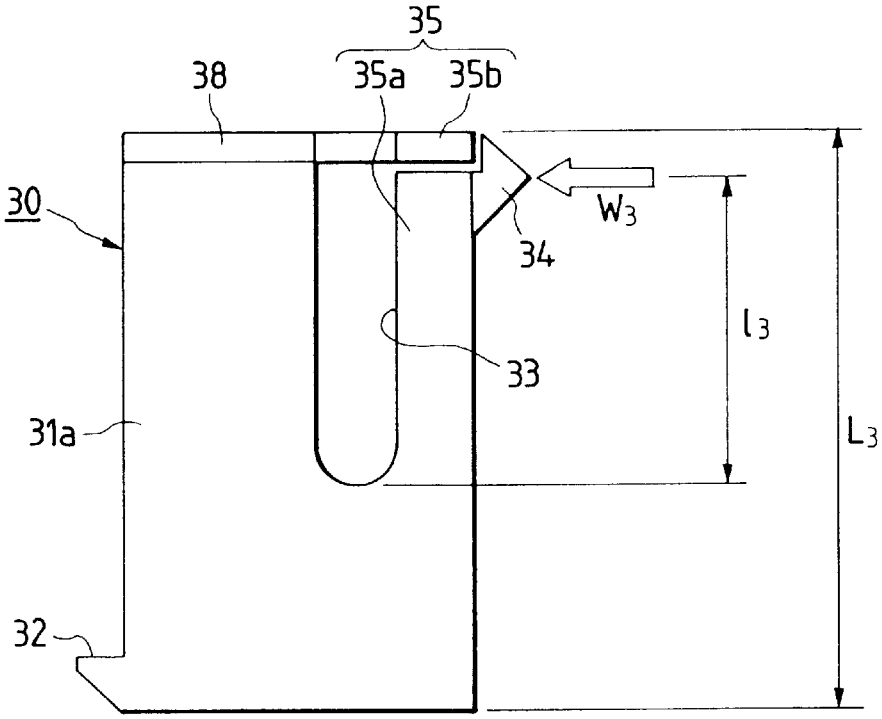
FIG. 5 is a side view showing a spacer retaining structure, which is a second mode of embodiment of the invention.
Figure 7:
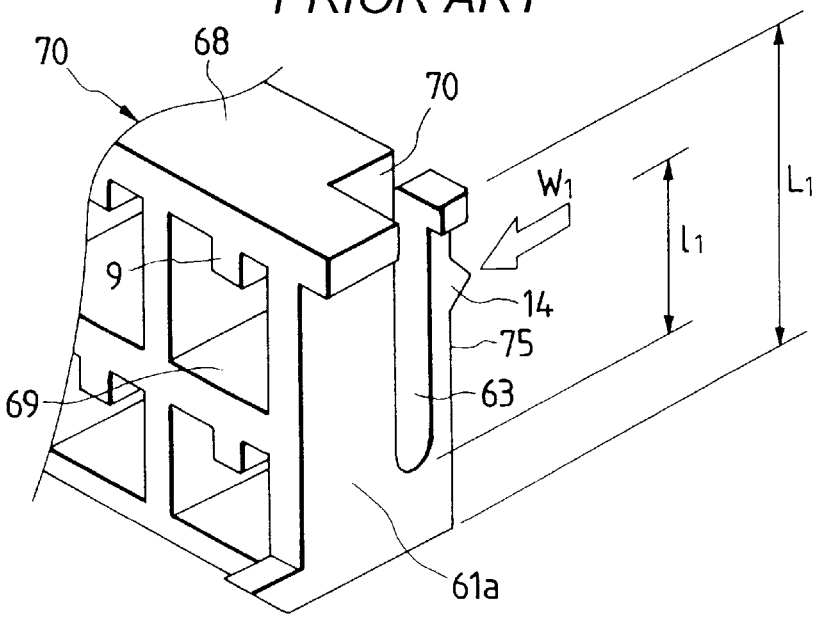
FIG. 7 PRIOR ART
FIG. 7 is a partial perspective view showing another exemplary conventional spacer retaining structure.
Figure 6:
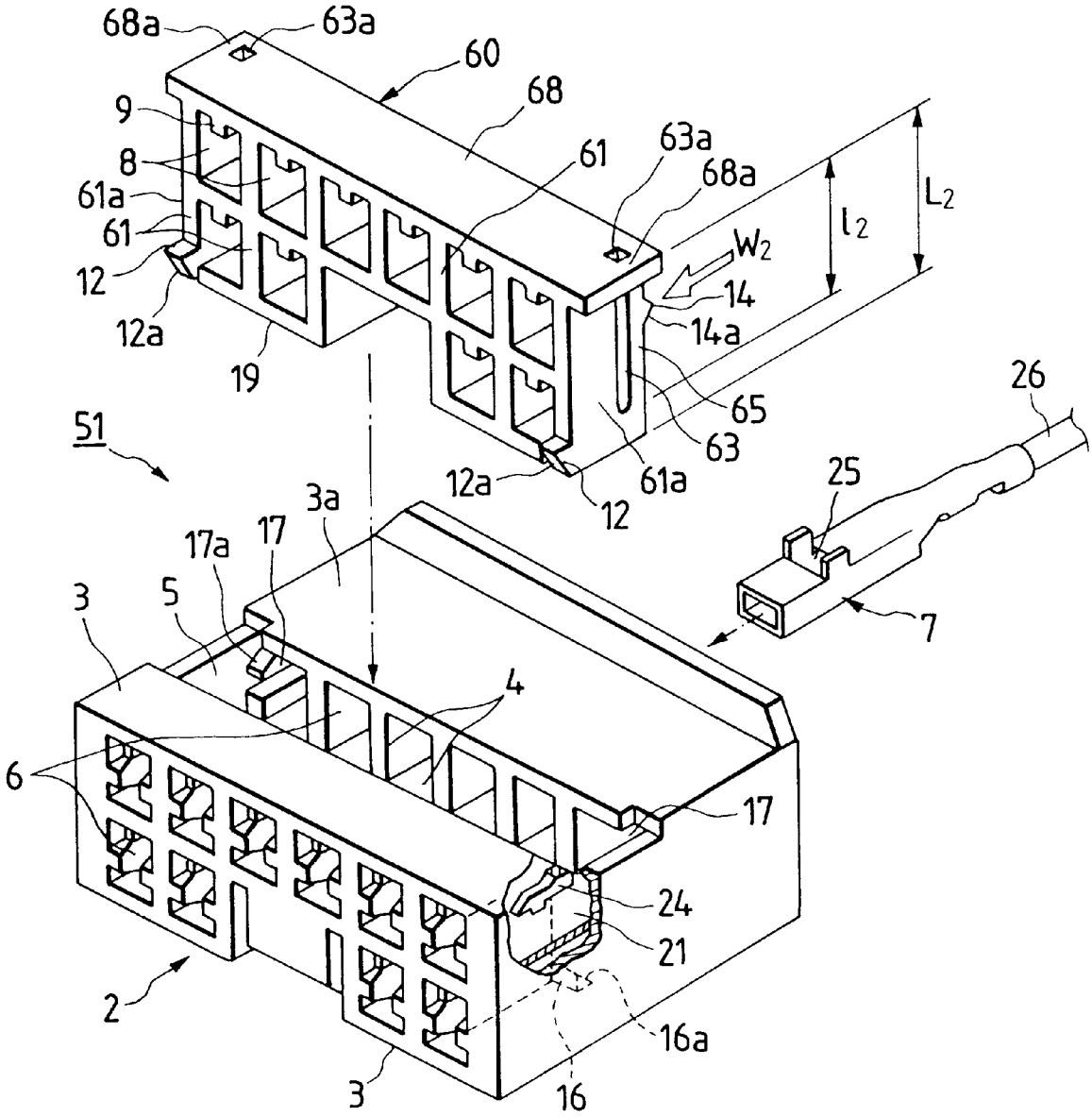
FIG. 6 PRIOR ART
FIG. 6 is an exploded perspective view showing an exemplary conventional spacer retaining structure.

Spacer retaining structures, which are modes of embodiment of the invention, will now be described in detail with reference to FIGS. 1 to 5. FIG. 1 is an exploded perspective view showing a spacer retaining structure, which is a first mode of embodiment of the invention; FIG. 2 is a diagram illustrative of a retained condition of a spacer in FIG. 1; FIG. 3 is a longitudinal sectional view showing an assembled condition in FIG. 1; FIG. 4 is a diagram illustrative of an operation around slits in FIG. 1; and FIG. 5 is a side view showing a spacer retaining structure, which is a second mode of embodiment of the invention.

As shown in FIGS. 1 to 3, a spacer retaining structure 1, which is the first mode of embodiment of the invention, has a housing 2 and a latticelike spacer 10. The housing 2 has not only a plurality of axially extending terminal accommodating chambers 6 arranged therein, but also a hollow portion 5 formed in the middle portion of one of outer peripheral walls 3, i.e., a top wall 3*a* so as to pass through the housing 2 vertically while traversing partition walls 4. The spacer 10 has not only openings 8 that correspond to the plurality of terminal accommodating chambers 6 but also lock portions 9 that retain connecting terminals 7 at the openings 8, and moves from a temporarily retained position to a regularly retained position while inserted from the hollow portion 5.

Each of vertical wall portions 11 that constitute the spacer 10 according to this mode of embodiment has not only a temporarily retaining projection 12 disposed on the front end face side thereof, but also a beamlike flexible member 15 having a regularly retaining projection 14 arranged through slits 13 on the rear end face side thereof. Further, the housing 2 has temporarily retaining portions and regularly retaining portions 17 arranged. Each temporarily retaining portion 16 is engageable with the corresponding temporarily retaining projection 12 when the openings 8 are inserted to positions substantially coinciding with the terminal accommodating chambers 6, and each regularly retaining portion 17 is engageable with the corresponding regularly retaining projection 14 when the lock portion 9 engages with a corresponding retaining hole 25 of a connecting terminal 7 to reach a regularly retained position from the aforementioned retained position, the regularly retained position being a position at which the terminal is prevented from being released from the rear.

Further, not only each regular retaining projection 14 is arranged close to a corner portion 20 between a side wall 11*a* and a top wall 18, but also each slit 13 is formed so as to extend over the corner portion 20 between the side wall 11*a* and the top wall 18. The side walls 11*a* are the vertical side walls 11 positioned at both ends of the spacer 10.

It may be noted that flexible lock arms 24, each being engageable with a retaining hole 25 of a connecting terminal 7, are arranged on inner peripheral walls confronting a bottom wall 21 in the front of the plurality of terminal accommodating chambers 6 independently of the lock portions 9, Further, in order to facilitate the retaining operation, not only slopes 12*a*, 16*a* are arranged on the lower surface of each temporarily retaining projection 12 and the upper surface of each temporarily retaining portion 16, but also slopes 14*a*, 17*a* are arranged on the upper and lower surfaces of each regularly retaining projection 14 and the upper surface of each regularly retaining portion 17.

In the thus constructed spacer retaining structure 1 according to this mode of embodiment, first, as shown in FIG. 2(*a*), the spacer 10 is inserted from above the hollow portion 5 of the housing 2, and when the spacer 10 has reached the temporarily retaining position, the temporarily retaining projections 12 are retained by the temporarily retaining portions 16. At this instance, the openings 8 of the spacer 10 substantially coincide with the terminal accommodating chambers 6. Then, when a connecting terminal 7 is inserted from the rear end of a terminal accommodating chamber 6, the retaining hole 25 is retained by the flexible lock arm 24, so that the connecting terminal 7 can be prevented from being released from the rear.

Then, as shown in FIG. 2(*b*), when the spacer 10 is pushed further downward, not only the regularly retaining projections 14 are retained by the regularly retaining portions 17, so that the spacer 10 is retained at the regularly retained position, but also the connecting terminal 7 is retained by the corresponding lock portion 9, so that the connecting terminal 7 can be prevented from being released from the rear doubly as shown in FIG. 3.

The aforementioned spacer retaining structure 1 not only has the regularly retaining projections 14 disposed close to the corner portions 20 between the side walls 11*a* positioned on both ends of the spacer 10 and the top wall 18, but also has the slits 13 disposed so as to extend over the corner portions between the side walls 11*a* and the top wall 18 in such a manner that the slits 13 extend over at right angles to each other at each corner portion 20.

Therefore, it can be said that the spacer 10 is constructed in such a manner that the ends of the cantilevered flexible members 15*a*, 15*b* are coupled at the corner portion 20 as shown in FIG. 4, so that the length $l_3$ of each slit can be shortened, which in turn contributes to reducing the height $L_3$ of the spacer 10 as well. As a result, the spacer 10 and the housing 2 can be downsized.

Further, not only the pushing force $W_3$ that serves as a holding force of the regularly regaining projections 14 can be almost doubled without increasing the maximum stress caused when the simple cantilevered flexible member (see FIG. 8) have flexed, but also the maximum stress caused within the flexible members 15*a*, 15*b* can be reduced despite the fact that the pushing force $W_3$ is large. Therefore, even if the spacer 10 is attached to and detached from the housing 2 frequently, there is no likelihood that the flexible members 15*a*, 15*b* become so weak as to be plastically deformed or even broken in some cases. Hence, the reliability of the connector can be improved.

Further, the flexible members 15 of the spacer 10 according to this mode of embodiment are characterized as having the cantilevered flexible members 15*a*, 15*b* coupled to each other at the corner portion 20. Therefore, even if the amount of flexion of the flexible member 15 is the same as that of the cantilevered flexible member 75 (see FIG. 8), the maximum tensile stress caused within the flexible member 15 is larger. In addition, the holding force $W_3$ serving as a pushing force becomes almost doubled. Hence, the reliability of the connector can be further improved.

Then, a spacer retaining structure, which is a second mode of the invention, will be described. The construction of the housing is the same as that in the former mode of embodiment. A spacer 30 has not only temporarily retaining projections 32 on the front end face side of each side wall 31*a*, but also beamlike flexible members 35 having regularly retaining projections 34 arranged through slits 33 that are formed so as to extend over the side walls 31*a* on the rear end face side and a top wall 38. Each flexible member 35 has an end thereof bifurcated with both flexible members 35*a*, 35*b* arranged so as to be adjacent to each other. Not only the regularly retaining projection 34 is arranged so as to project from the front end of the flexible member 35*a*, but also the front end of the regularly retaining projection 34 is arranged so as to overlap on the flexible member 35*b*.

Therefore, the holding force is doubled, and in addition, the maximum tensile stress is reduced to a small value. As a result, the reliability of the connector can be further improved.

The invention is not limited to the aforementioned modes of embodiment, but may be embodied in other modes while appropriately modified. For example, while the slits of the spacer are arranged so as to extend over the side wall and the top wall in this mode of embodiment, the slits may extend over the side wall and the bottom wall at right angles to each other. However, in this case, not only the regularly retaining projection must be arranged at the corner portion on the bottom wall side, but also the regularly retaining portion must be arranged at the corresponding position close to the bottom wall of the housing.

As described in the foregoing, according to the spacer retaining structure of the invention of the present invention, not only the regularly retaining projections are arranged close to the corner portions between the side walls and either the top wall or the bottom wall of the spacer, but also the slits are formed so as to extend over the side walls and either the top wall or the bottom wall close to the corner portions.

Therefore, it can be said that the spacer retaining structure is constructed so that the ends of the two cantilevered flexible members arranged so as to be at right angles to each other are coupled to each other at each corner portion. As a result, not only the length of each slit can be reduced with respect to the amount of flexion, but the height of the spacer can be reduced as well. Hence, both the spacer and the housing can be downsized, which in turn contributes to a cost reduction of the connector.

Further, not only the holding force of the regularly retaining projections can be almost doubled without increasing the maximum stress caused when a simple cantilevered flexible member has flexed, but also the maximum stress caused within the flexible members can be reduced to a small value although the holding force given by such flexible members is large. Therefore, even if the spacer is attached to and detached from the housing frequently, the plastic deformation or breakage of the flexible members due to the flexible members becoming weak can be prevented reliably, which in turn contributes to improving the reliability of the connector.

Still further, according to the spacer retaining structure of the present invention, not only the flexible member formed by the slits is separated close to the corner portion, but also the regularly retaining projection is arranged so as to project from the front end of one of the separated flexible members and the regularly retaining projection is brought into contact with the front end of the other separated flexible member.

Therefore, not only the holding force of the regularly retaining projections become two times that of a simple cantilevered flexible member, but also the maximum tensile stress of the flexible members can be controlled to a small value. As a result, the reliability of the connector can be further improved.

What is claimed is:

1. A spacer retaining structure comprising:

a housing including:

outer peripheral walls;

a plurality of axially extending terminal accommodating chambers arranged in the housing;

a hollow portion formed in the housing, the hollow portion having an opening in the middle of one of the outer peripheral walls by partitioning the one of the peripheral walls; and at least one temporarily retaining portion and at least one regularly retaining portion formed in the hollow portion; and a connecting terminal locking spacer capable of moving from a temporarily retained position to a regularly retained position while inserted in the hollow portion, the connecting terminal locking spacer including:

a pair of end walls in axial direction and side walls;

a top wall and a bottom wall;

openings corresponding to the terminal accommodating chambers, the openings having lock portions for locking connecting terminals;

at least one temporarily retaining projection on one of the end walls, the temporarily retaining projection being engageable with the temporarily retaining portion when the connecting terminal are inserted in the hollow portion and the openings coincides with the terminal accommodating chambers; and a beamlike flexible member defined by a slit in the spacer, having at least one regularly retaining projection on the other of the end walls, the regularly retaining projection being engageable with the regularly retaining portion when the connecting terminal locking spacer is in the regularly retained position and the lock portions engage with the connecting terminals to hold the connecting terminals in the terminal accommodating chambers, wherein the regularly retaining projection is formed close to a corner portion between the end walls and one of the top and bottom walls of the spacer, and the slit extend over one of the side walls and over a substantial portion of one of the top and bottom walls close to the corner portion.

2. A spacer retaining structure according to claim 1, wherein the connecting terminal locking spacer has a pair of the flexible members separated at the corner portion by the slit, and the regularly retaining projection projects from a front end of one of the separated flexible members and contacts with a front end of the other one of the separated flexible members.

* * * * *

UNITED STATES PATENT AND TRADEMARK OFFICE

CERTIFICATE OF CORRECTION

PATENT NO. : 6,010,374
DATED : January 4, 2000
INVENTOR(S) : Takeya Miwa

It is certified that error appears in the above-identified patent and that said Letters Patent is hereby corrected as shown below:

Title Page, Item [57], in the Abstract, line 11, before "a side wall", delete "the".

Claim 1, Column 9:
Line 4, "terminal are" should read --terminal is--.

Claim 1, Column 9:
Line 5, "openings coincides" should read --openings coincide--.

Claim 1, Column 10:
Lines 3-4, "slit extend", should read --slit extends--.

Signed and Sealed this

Twelfth Day of June, 2001

Nicholas P. Godici

*Attest:*

*Attesting Officer*

NICHOLAS P. GODICI
*Acting Director of the United States Patent and Trademark Office*